US011713767B2

(12) United States Patent
You et al.

(10) Patent No.: US 11,713,767 B2
(45) Date of Patent: Aug. 1, 2023

(54) INFLATION PRODUCT WITH BUILT-IN AIR PUMP

(71) Applicant: Yiwu Locyop Household Product co., Ltd., Zhejiang (CN)

(72) Inventors: Wenbiao You, Zhejiang (CN); Changwei Long, Zhejiang (CN)

(73) Assignee: Yiwu Locyop Household Product co., Ltd., Yiwu (CN)

( * ) Notice: Subject to any disclaimer, the term of this patent is extended or adjusted under 35 U.S.C. 154(b) by 79 days.

(21) Appl. No.: 17/488,822

(22) Filed: Sep. 29, 2021

(65) Prior Publication Data

US 2023/0064182 A1 Mar. 2, 2023

(30) Foreign Application Priority Data

Aug. 28, 2021 (CN) ..... 202110998764.4

(51) Int. Cl.

| | |
|---|---|
| ***F04D 27/00*** | (2006.01) |
| ***F04D 25/06*** | (2006.01) |
| ***F04B 41/02*** | (2006.01) |
| ***A47C 27/08*** | (2006.01) |
| ***F04D 25/08*** | (2006.01) |
| ***F04D 29/40*** | (2006.01) |
| ***F04D 25/12*** | (2006.01) |

(52) U.S. Cl.

CPC ..... *F04D 27/004* (2013.01); *A47C 27/082* (2013.01); *F04B 41/02* (2013.01); *F04D 25/0673* (2013.01); *F04D 25/08* (2013.01); *F04D 25/12* (2013.01); *F04D 29/403* (2013.01)

(58) Field of Classification Search

CPC ..... A47C 27/082; F04B 41/02; F04D 25/08; F04D 25/0673; F04D 27/004; F04D 29/403; F04D 29/602

See application file for complete search history.

(56) References Cited

U.S. PATENT DOCUMENTS

| | | | | |
|---|---|---|---|---|
| 10,508,651 | B2 * | 12/2019 | Liu | F16K 15/147 |
| 10,716,408 | B2 * | 7/2020 | Yang | F04D 25/068 |
| 2010/0247355 | A1 * | 9/2010 | Pan | F04D 25/084 417/423.14 |
| 2020/0049156 | A1 * | 2/2020 | Lau | F04D 25/084 |

* cited by examiner

*Primary Examiner* — Charles G Freay

(74) *Attorney, Agent, or Firm* — Dragon Sun Law Firm, PC; Nathaniel Perkins

(57) ABSTRACT

The present disclosure provides an inflation product with a built-in air pump, including an air pump (1), a connection piece (2) and an inflation product (15). The inflation product (15) includes a through hole (151) penetrating from inside to outside, the connection piece (2) is fixed at an opening of the through hole (151), the air pump (1) and the connection piece (2) are detachably connected, and the through hole (151) is provided for the air pump (1) to protrude into with a front end of the air pump (1) exposed outside the through hole (151). The front end of the air pump (1) includes an air inlet (3) in which a normally-closed switch is mounted, and an air inlet sealing cover (5) for driving the normally-closed switch (4) to be pressed down is covered on the air inlet (3).

10 Claims, 9 Drawing Sheets

INFLATION PRODUCT WITH BUILT-IN AIR PUMP

CROSS-REFERENCE TO RELATED APPLICATION

This application claims priority from the Chinese patent application 202110998764.4 filed Aug. 28, 2021, the content of which is incorporated herein in the entirety by reference.

TECHNICAL FIELD

The present disclosure relates to the field of inflation product technologies, and in particular to an inflation product with a built-in air pump.

BACKGROUND

At present, inflation products including inflation sofas, inflation beds, etc. utilize air pumps such as external pumps, air-pump-free inflation through running, and built-in air pumps. External pumps are difficult to use and may easily break down, and it is very difficult for an inexperienced person to inflate to full by the air-pump-free inflation through running. As such, built-in air pumps are preferred for their ease of use. However, the built-in air pumps of many inflation products are not detachable and thus difficult to repair. Further, the inflation process may include opening the sealing cover and turning on the switch, and after the product is fully inflated, it is required to close the sealing cover and turn off the switch. The whole process may be inconvenient for many users.

SUMMARY

In order to solve the aforementioned defects of the prior art, the present disclosure provides an inflation product with a built-in air pump.

The present disclosure employs the following technical solution: there is provided an inflation product with a built-in air pump, including an air pump, a connection piece and an inflation product, wherein the inflation product includes a through hole penetrating through the inflation product, the connection piece is coupled to an opening of the through hole, the air pump and the connection piece are detachably connected, the air pump protrudes into the through hole such that a front end of the air pump is disposed outside the through hole.

The front end of the air pump is provided with an air inlet in which a normally-closed switch is mounted, and an air inlet sealing cover is configured to depress the normally-closed switch and cover the air inlet.

Further, the connection piece includes an inner sealing clamping plate and an outer sealing clamping plate, wherein the inner sealing clamping plate is fixed at an inner wall of the inflation product, and the outer sealing clamping plate is disposed outside of the inflation product and fixed to a front end of the inner sealing clamping plate.

Still further, the inner sealing clamping plate and the outer sealing clamping plate are both annular, the front end of the inner sealing clamping plate is provided with a clamping ring disposed outside of the through hole, and the outer sealing clamping plate is fixed to the clamping ring via a catch.

Still further, the air pump is connected to the connection piece by thread connection or bonding.

Still further, when the air pump is connected to the connection piece by thread connection, the connection piece includes an internal thread hole penetrating through the connection piece, and an external thread portion mated with the internal thread hole is disposed on an outer wall of the air pump.

Still further, a protective sleeve encloses a front end of the normally-closed switch, and a rear end of the air inlet sealing cover protrudes into the air inlet and is pressed onto a front-end surface of the protective sleeve.

Still further, the rear end of the air inlet sealing cover protrudes into the air inlet and is pressed onto a front-end surface of the normally-closed switch.

Still further, the front end of the air pump is provided with a charge port covered by a charge port sealing cover.

Still further, the air pump includes an outer cover and an inner housing, which are fixedly connected, the outer cover is disposed outside of the inflation product, the inner housing protrudes into the inflation product, the air inlet and the charge port are both disposed on the outer cover, a circuit board, a battery, a fan and a motor are mounted inside the inner housing, and the normally-closed switch is in electrical connection with the circuit board.

Furthermore, pull ropes are fixed at a rear end of each of the air inlet sealing cover and the charge port sealing cover, and rear ends of the pull ropes are fixed inside the air inlet and the charge port respectively.

The inflation production with a built-in air pump according to the present disclosure includes the following beneficial effects:

The air pump and the connection piece are detachably connected to each other, and the connection piece is fixed on the inflation product. The air pump can be dismounted to facilitate maintenance. After the air pump is dismounted, articles may be placed into the inflation product so that the inflation product includes a storage function.

When the air inlet sealing cover is opened, the air pump is powered on to inflate the inflation product. When the air inlet sealing cover is closed, the air pump is powered off to stop inflation, bringing ease of use.

BRIEF DESCRIPTIONS OF THE DRAWINGS

Figure 1:
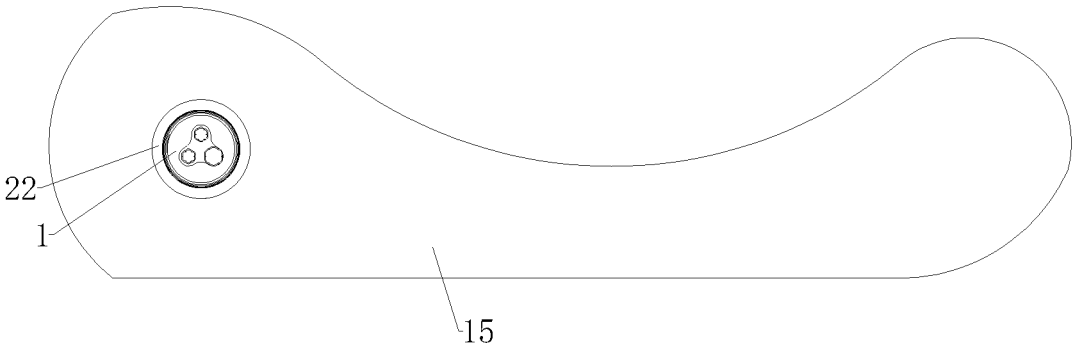
FIG. 1 is a schematic diagram of an entire structure of an inflation product according to embodiment 1 of the present disclosure.
Figure 2:
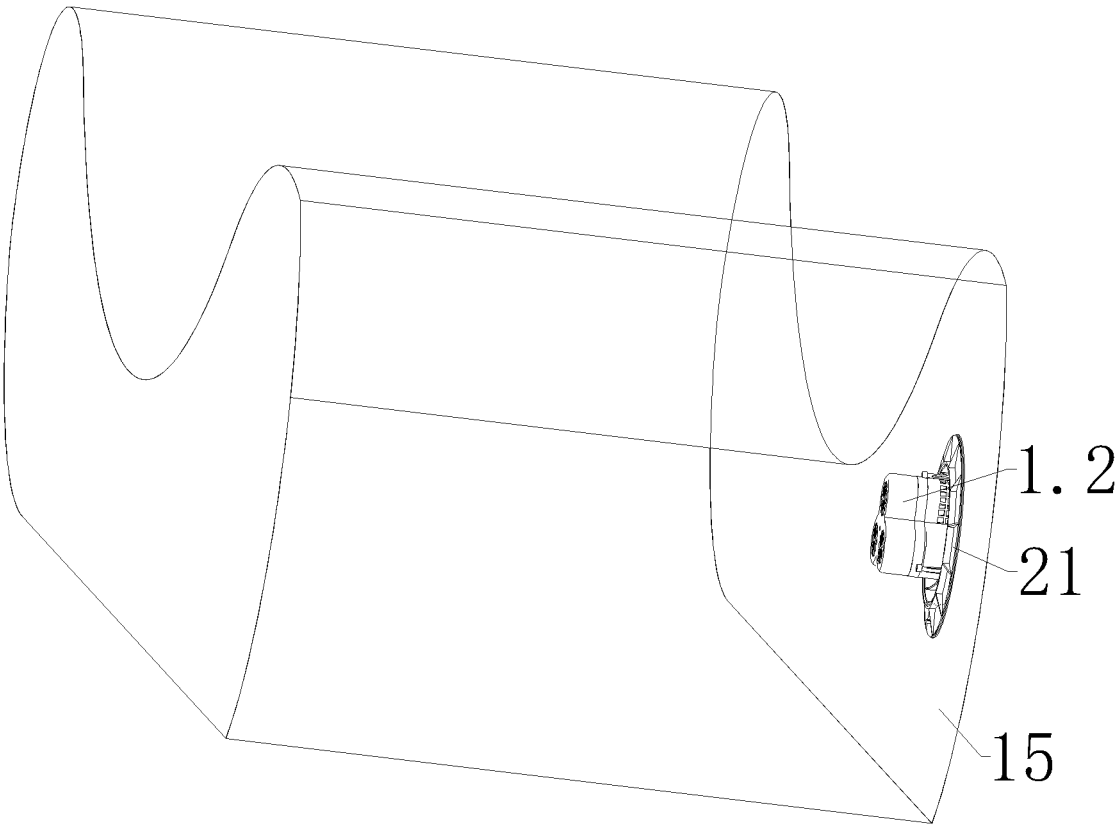
FIG. 2 is a schematic diagram of an internal structure of an inflation product according to embodiment 1 of the present disclosure.

Numerals of drawings are described below: 1—air pump, 1.1—outer cover, 1.1.1—external thread portion, 1.2—inner housing, 2—connection piece, 21—inner sealing clamping plate, 211—internal thread hole, 212—clamping ring, 22—outer sealing clamping plate, 3—air inlet, 4—normally-closed switch, 5—air inlet sealing cover, 6—protective sleeve, 7—air outlet, 8—charge port, 9—air outlet sealing cover, 10—charge port sealing cover, 11—pull rope, 12—circuit board, 13—battery, 14—fan, 15—inflation product, 151—through hole, and 16—motor.

DETAILED DESCRIPTIONS OF EMBODIMENTS

In order to fully describe the technical solution of the present disclosure, non-limiting feature descriptions are included in combination with the accompanying drawings of the present disclosure.

Embodiment 1: as shown in FIGS. 1-11, an inflation product with a built-in air pump includes an air pump 1, a connection piece 2 and an inflation product 15. The inflation product 15 includes a through hole 151 penetrating from inside to outside of the inflation product, the connection piece 2 is fixed at an edge of an opening of the through hole 151, the air pump 1 and the connection piece 2 are detachably connected, and the air pump 1 protrudes into the through hole 151 such that a front end of the air pump 1 is disposed outside the through hole 151. The front end of the air pump 1 is provided with an air inlet 3 in which a normally-closed switch 4 is disposed, and an air inlet sealing cover 5 configured to depress the normally-closed switch 4 and cover the air inlet 3.

The connection piece 2 includes an inner sealing clamping plate 21 and an outer sealing clamping plate 22. The inner sealing clamping plate 21 is fixed on an inner wall of the inflation product 15 via double-faced adhesive tape, and the outer sealing clamping plate 22 is disposed outside the inflation product 15 and fixed to a front end of the inner sealing clamping plate 21.

Figure 5:
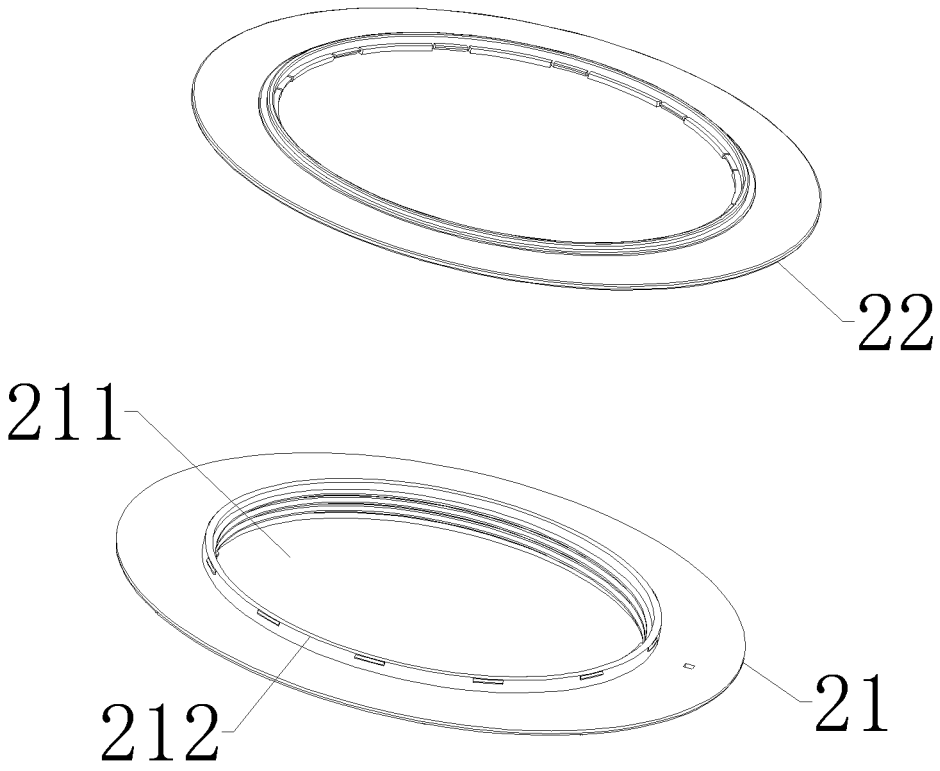
FIG. 5 is an exploded view of a connection piece according to embodiment 1 of the present disclosure.

As shown in FIG. 5, to enable connection between the inner sealing clamping plate 21 and the outer sealing clamping plate 22, the inner sealing clamping plate 21 and the outer sealing clamping plate 22 are annularly shaped, the front end of the inner sealing clamping plate 21 is provided with a clamping ring 212 disposed outside of the through hole 151, and the outer sealing clamping plate 22 is fixed to the clamping ring 212 via a catch.

Figure 4:
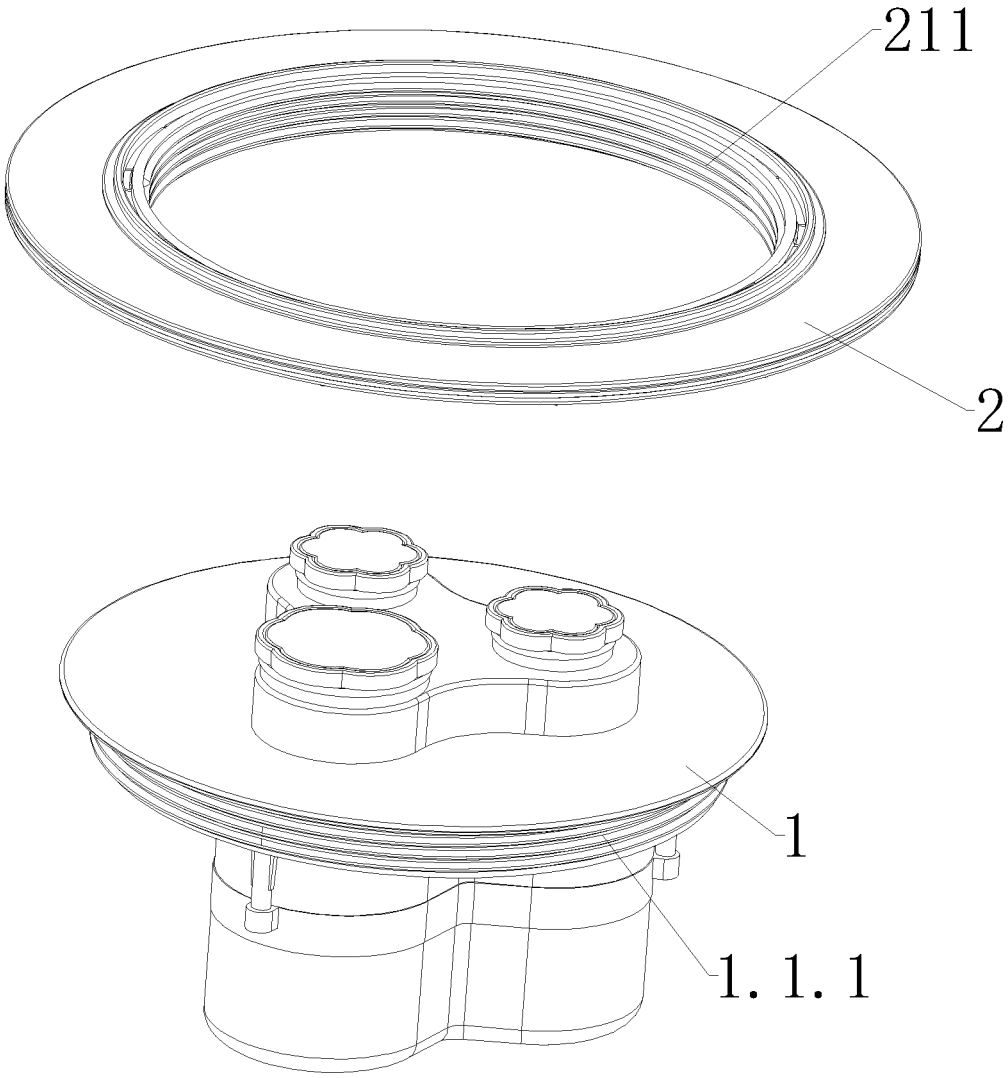
FIG. 4 is a schematic diagram of a connection piece and an air pump according to embodiment 1 of the present disclosure.

As shown in FIG. 4, to enable mounting and dismounting of the air pump 1, the air pump 1 is coupled to the connection piece 2 via a threaded connection. The connection piece 2 includes an internal thread hole 211 penetrating through the connection piece, the internal thread hole 211 is disposed on the inner sealing clamping plate 21, and an external thread portion 1.1.1 mated with the internal thread hole 211 is disposed on an outer wall of the air pump 1.

Figure 9:
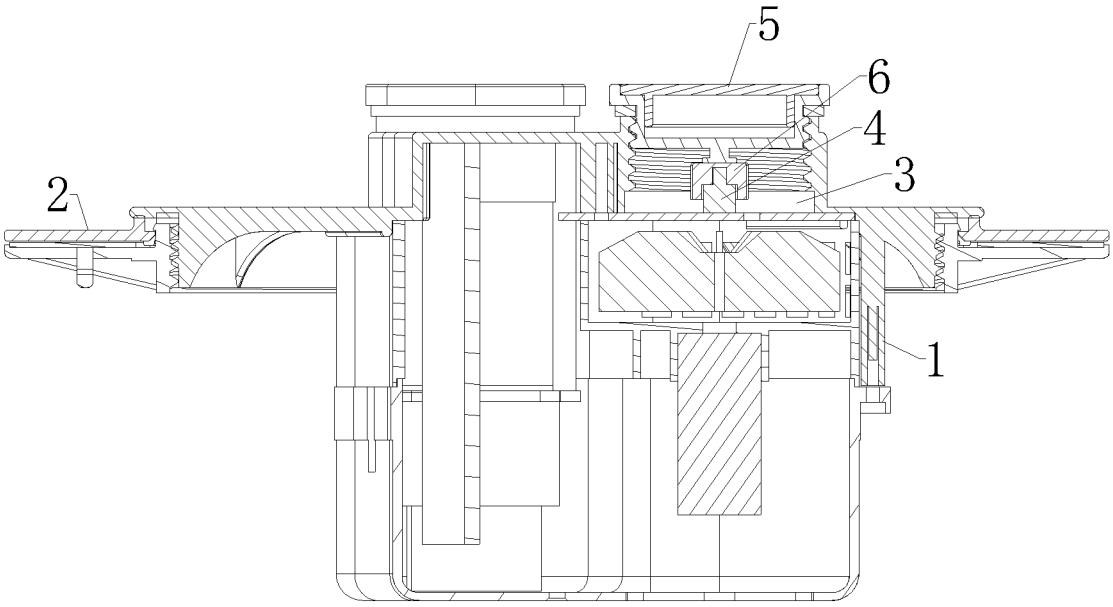
FIG. 9 is a sectional view taken along plane A-A of FIG. 8.

As shown in FIG. 9, a protective sleeve 6 encloses a front end of the normally-closed switch 4, and a rear end of the air inlet sealing cover 5 protrudes into the air inlet 3 and is pressed onto a front surface of the protective sleeve 6. When the air inlet sealing cover 5 covers the air inlet 3, the rear end of the air inlet sealing cover 5 squeezes the protective sleeve 6 and the normally-closed switch 4, and the normally-closed switch 4 is depressed to power off the air pump 1. When the air inlet sealing cover 5 is opened, the normally-closed switch 4 is released to power on the air pump 1 and inflate the inflation product 15.

Figure 3:
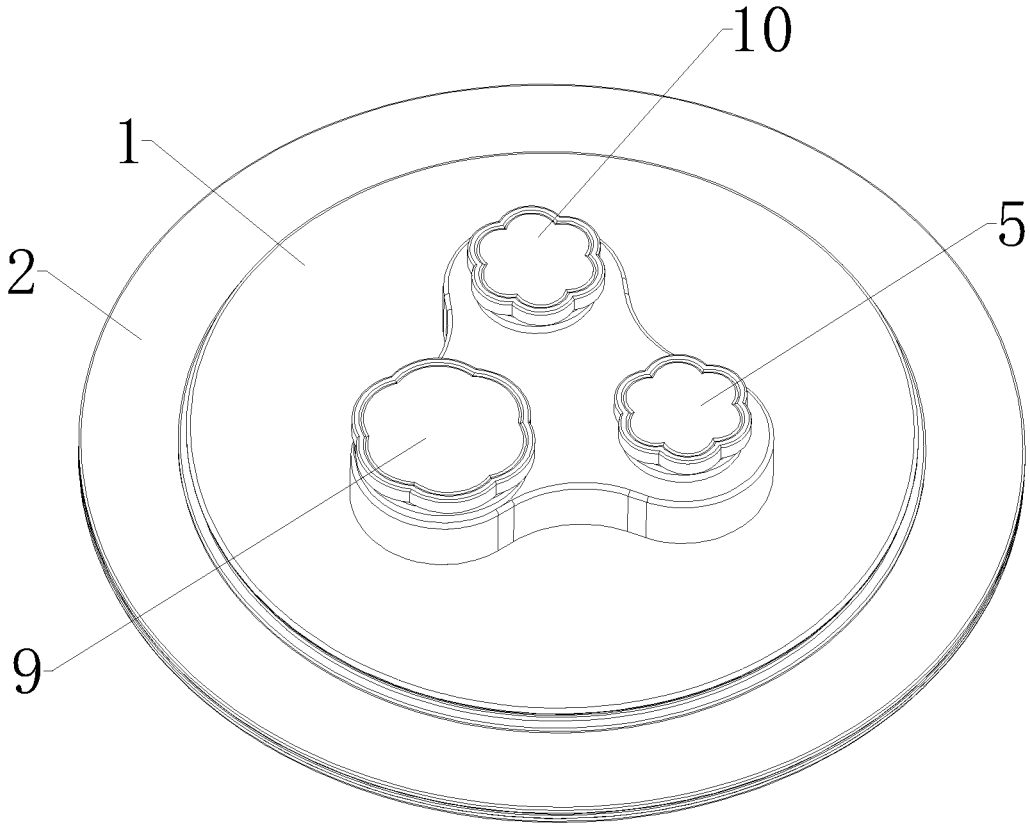
FIG. 3 is a schematic diagram of an entire structure of an air pump according to embodiment 1 of the present disclosure.
Figure 6:
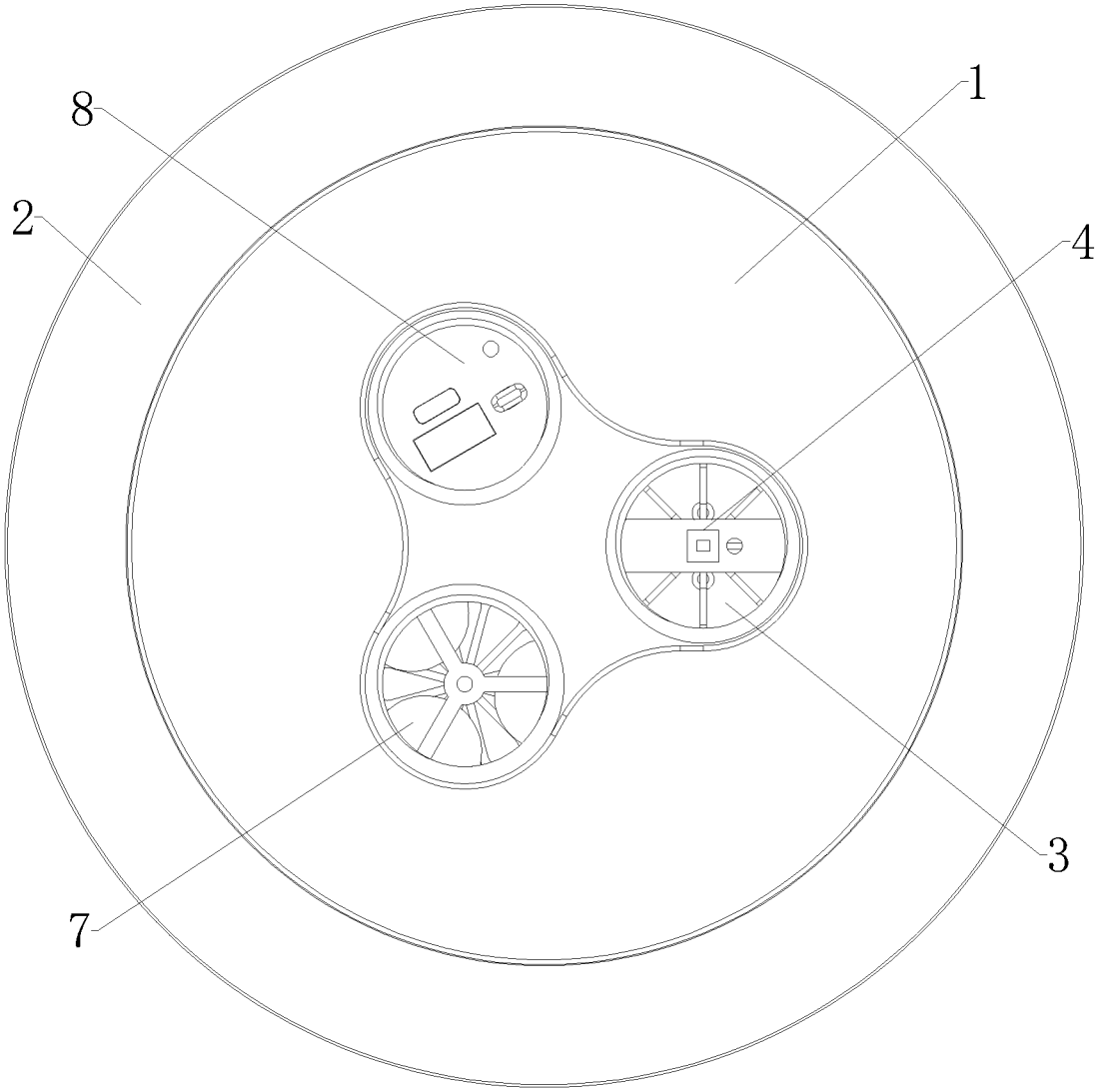
FIG. 6 is a front view of an air pump without an air inlet sealing cover, an air outlet sealing cover, and a charge port sealing cover according to embodiment 1 of the present disclosure.

As shown in FIGS. 3 and 6, the front end of the air pump 1 includes an air outlet 7 and a charge port 8. The air outlet 7 is covered with an air outlet sealing cover 9 and the charge port 9 is covered with a charge port sealing cover 10. Thus, the air inlet 3, the air outlet 7 and the charge port 8 are covered with the air inlet sealing cover 5, the air outlet sealing cover 9 and the charge port sealing cover 10, respectively, so as to achieve waterproof and dustproof functionality. A surface of the inflation product 15 is coated with a sealing material, and sealing treatment is performed between the connection piece 2, the air pump 1, and the inflation product 15 such that the entire inflation product with a built-in air pump can be utilized on water.

Figure 7:
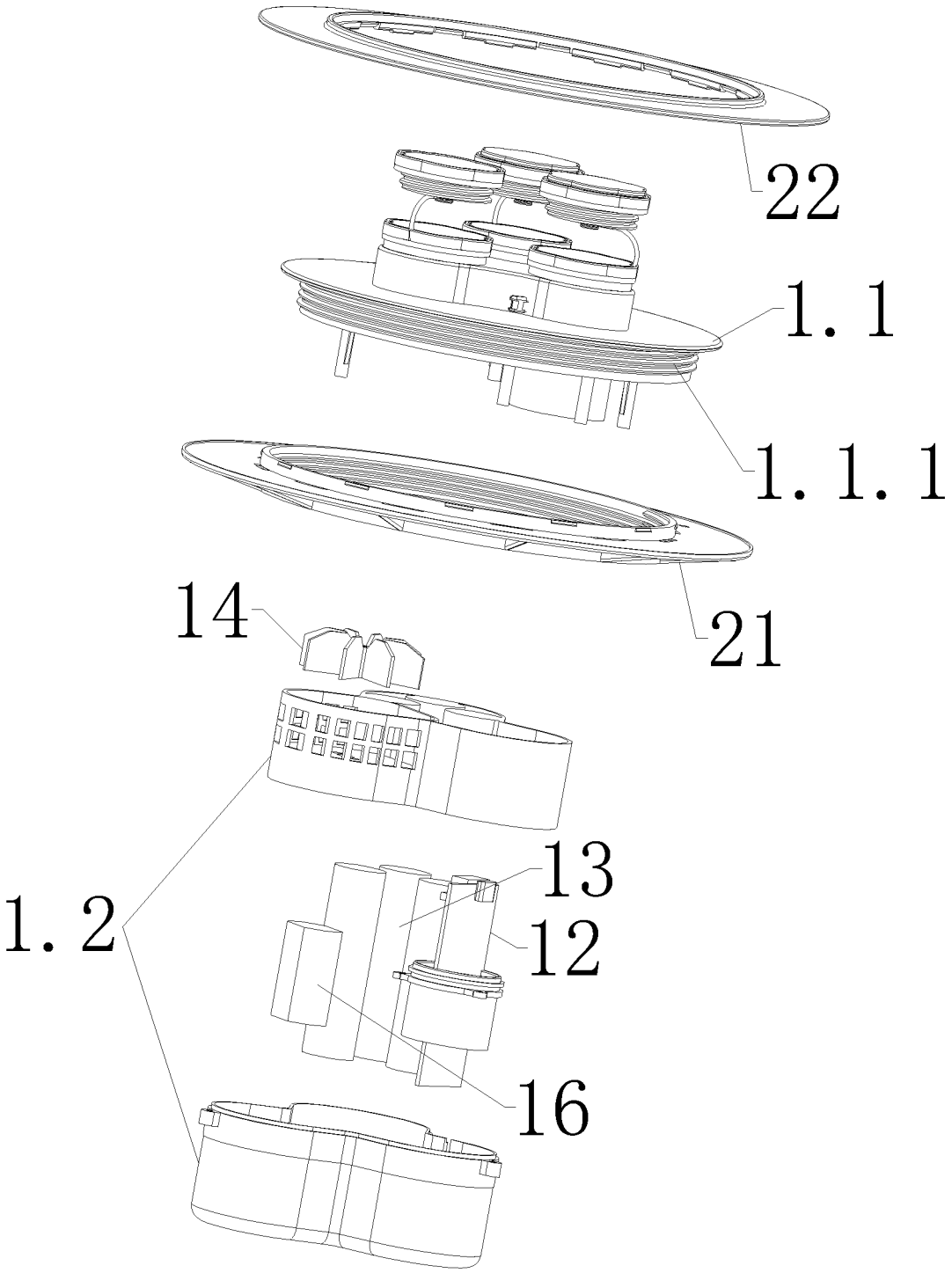
FIG. 7 is an exploded view of an air pump according to embodiment 1 of the present disclosure.
Figure 8:
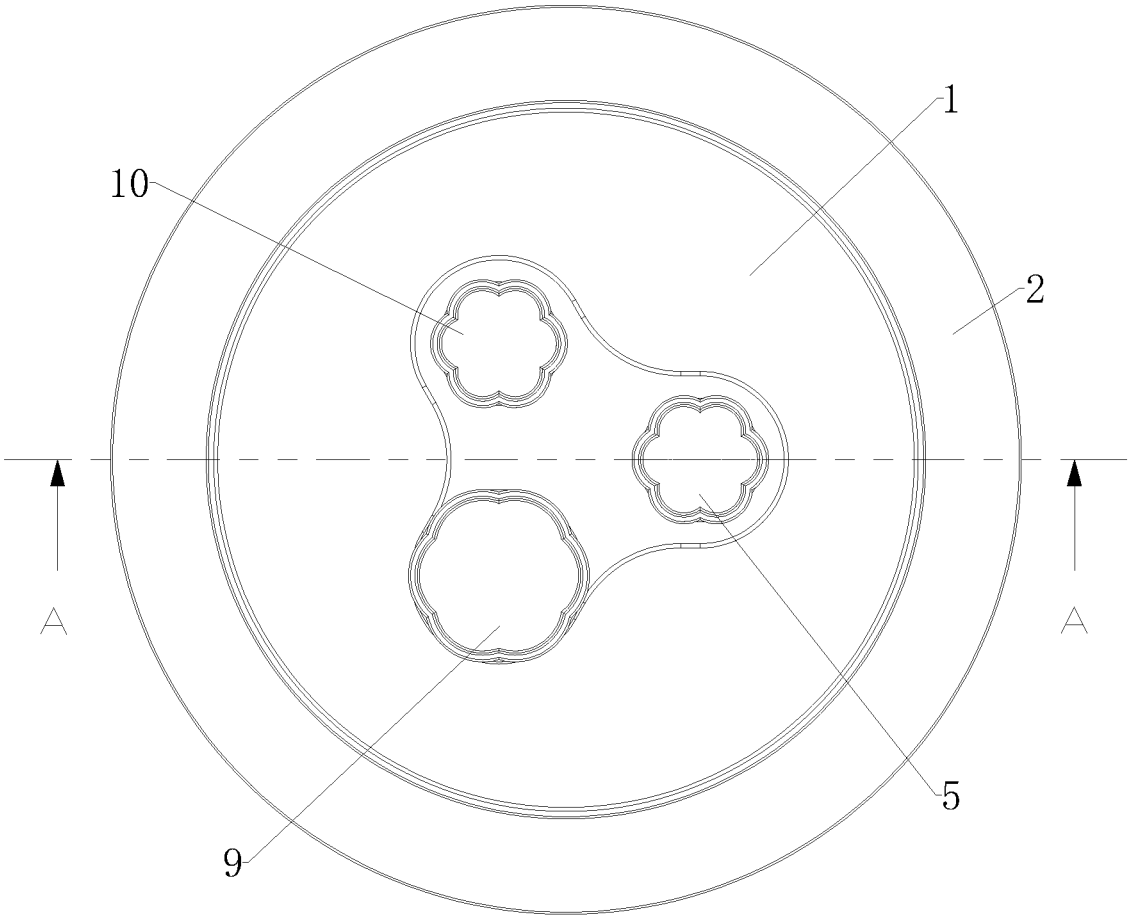
FIG. 8 is a front view of an air pump according to embodiment 1 of the present disclosure.

As shown in FIG. 7, the air pump 1 includes an outer cover 1.1 and inner housing 1.2 that are fixedly connected. The outer cover 1.1 is disposed outside the inflation product 15, and the inner housing 1.2 protrudes into the inflation product 15. The air inlet 3, the air outlet 7 and the charge port 8 are all disposed on the outer cover 1.1. The external thread portion 1.1.1 is disposed on an outer wall of the outer cover 1.1. A circuit board 12, a battery 13, a fan 14 and a motor 16 are mounted in the inner housing 1.2. The motor 16 is connected to the fan 14, and the normally-closed switch 4, the battery 13, and the motor 16 are all in electrical connection with the circuit board 12. The battery 13 is a rechargeable battery which can be charged via charge port 8. When powered on, the fan operates.

Figure 10:
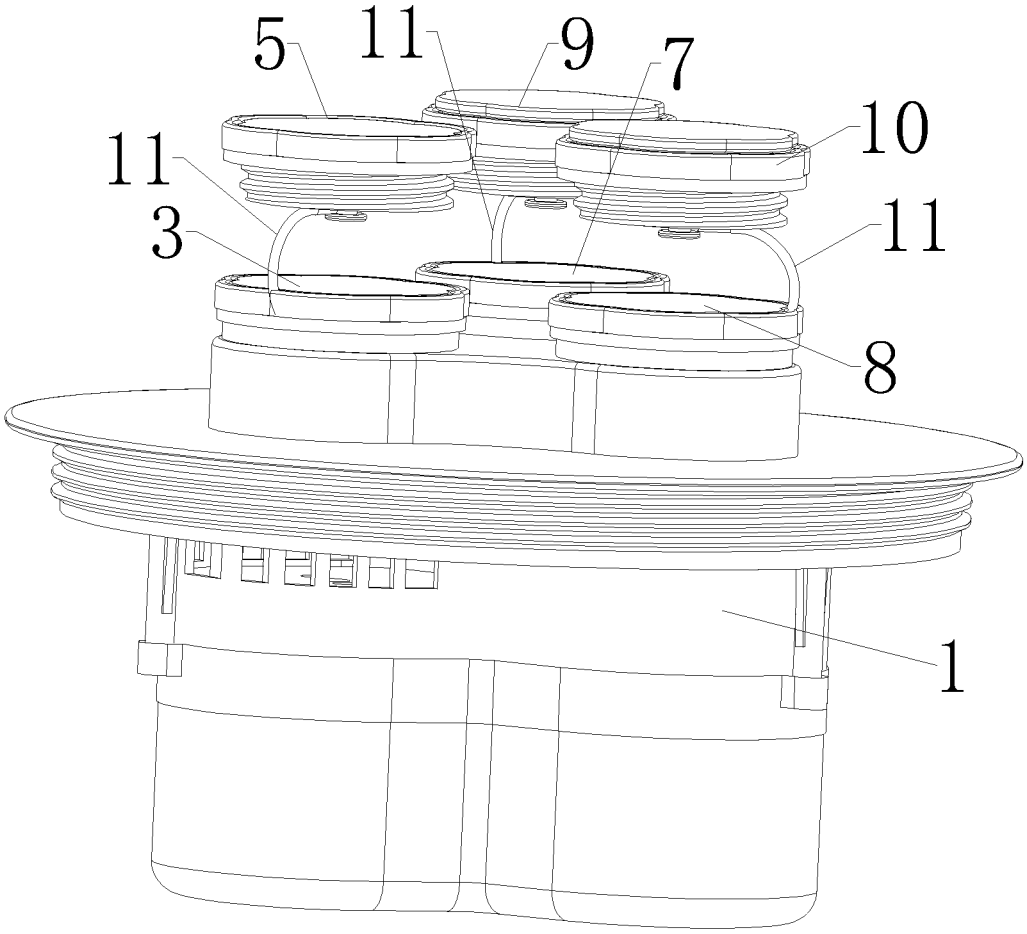
FIG. 10 is a schematic diagram of mounting a pull rope according to embodiment 1 of the present disclosure.
Figure 11:
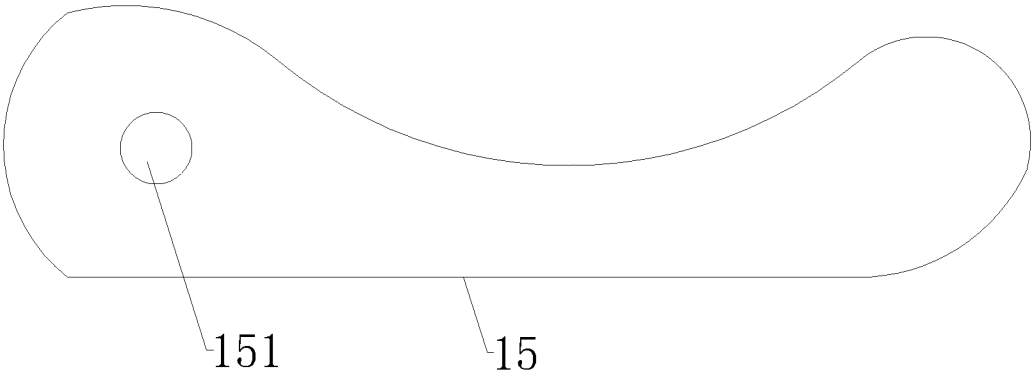
FIG. 11 is a front view of an inflation product according to embodiment 1 of the present disclosure.

As shown in FIG. 10, the rear end of each of the air inlet sealing cover 5, the air outlet sealing cover 9 and the charge port sealing cover 10 are fixedly connected to pull ropes 11, and rear ends of the three pull ropes are fixed inside the air inlet 3, the air outlet 7 and the charge port 8 respectively. By utilizing the pull ropes, the air inlet sealing cover 5, the air outlet sealing cover 9 and the charge port sealing cover 10 are prevented from being misplaced after being opened.

The air pump 1 can be dismounted to facilitate maintenance. After the air pump 1 is dismounted, the inflation product 15 may be utilized for storage as articles may be placed into the inflation product 15. When the air inlet sealing cover 5 is opened, the air pump 1 is powered on to inflate the inflation product 15. When the air inlet sealing cover 5 is closed, the air pump 1 is powered off to stop inflation, providing for ease of use.

Figure 12:
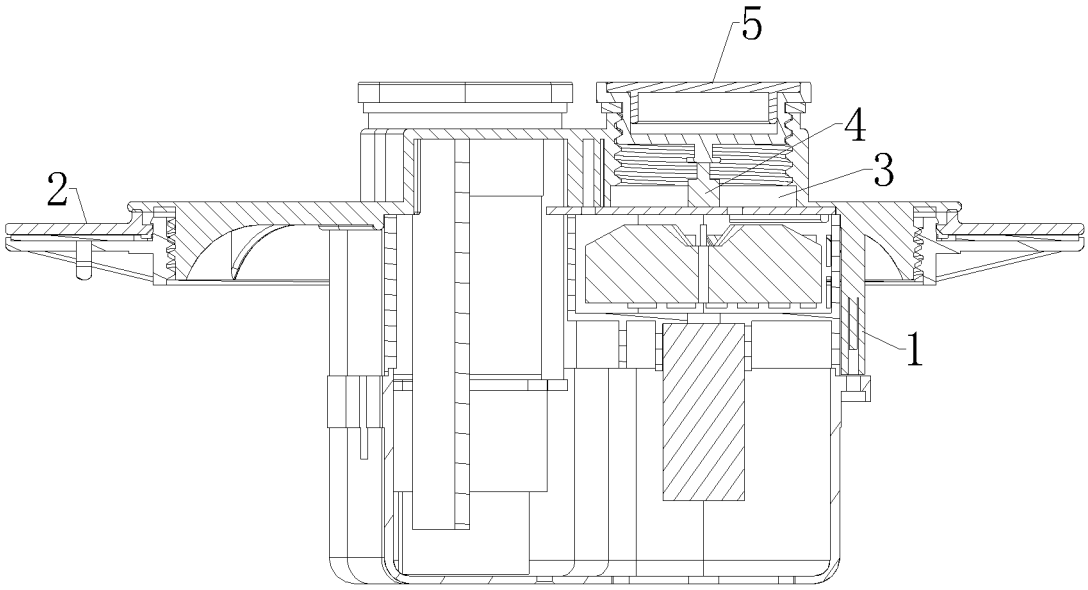
FIG. 12 is a sectional view of an air pump according to embodiment 2 of the present disclosure.

Embodiment 2: as shown in FIG. 12, in contrast with embodiment 1 the rear end of the air inlet sealing cover 5 of embodiment 2 protrudes into the air inlet 3 and is pressed onto the front-end surface of the normally-closed switch 4. When the air inlet sealing cover 5 covers the air inlet 3, the rear end of the air inlet sealing cover 5 squeezes the normally-closed switch 4 and the normally-closed switch is depressed to power off the air pump 1; and when the air inlet sealing cover 5 is opened, the normally-closed switch 4 is released to power on the air pump 1 and inflate the inflation product 15.

Embodiment 3: embodiment 3 differs from embodiment 1 in that the air pump is fixed to the connection piece 2 by bonding.

The descriptions disclosed herein merely describe several preferred embodiments of the present disclosure and do not limit the scope of protection of the present disclosure. Any simple modifications and equivalent structural changes made according to the specification and the accompanying drawings of the present disclosure shall all fall within the scope of protection of the present disclosure.

What is claimed is:

1. An inflation product comprising an air pump (1), a connection piece (2) and a through hole (151) penetrating through the inflation product (15), the connection piece (2) is fixed at an opening of the through hole (151), the air pump (1) and the connection piece (2) are detachably connected, the air pump (1) protrudes into the through hole (151) such that a front end of the air pump (1) is disposed outside the inflation product (15);

the front end of the air pump (1) is provided with an air inlet (3) in which a normally-closed switch (4) is mounted, and an air inlet sealing cover (5) is configured to depress the normally-closed switch (4) and cover the air inlet (3).

2. The inflation product of claim 1, wherein the connection piece (2) comprises an inner sealing clamping plate (21) and an outer sealing clamping plate (22), wherein the inner sealing clamping plate (21) is fixed at an inner wall of the inflation product (15), and the outer sealing clamping plate (22) is disposed outside of the inflation product (15) and fixed to a front end of the inner sealing clamping plate (21).

3. The inflation product of claim 2, wherein the inner sealing clamping plate (21) and the outer sealing clamping plate (22) are both annular, the front end of the inner sealing clamping plate (21) is provided with a clamping ring (212) disposed outside of the through hole (151), and the outer sealing clamping plate (22) is fixed to the clamping ring (212).

4. The inflation product of claim 1, wherein the air pump (1) is connected to the connection piece (2) by thread connection or bonding.

5. The inflation product of claim 4, wherein when the air pump (1) is connected to the connection piece (2) by thread connection, the connection piece (2) includes an internal thread hole (211) penetrating through the connection piece, and an external thread portion (1.1.1) mated with the internal thread hole (211) is disposed on an outer wall of the air pump (1).

6. The inflation product of claim 1, wherein a protective sleeve (6) encloses a front end of the normally-closed switch (4), and a rear end of the air inlet sealing cover (5) protrudes into the air inlet (3) and is pressed onto a front-end surface of the protective sleeve (6).

7. The inflation product of claim 1, wherein a rear end of the air inlet sealing cover (5) protrudes into the air inlet (3) and is pressed onto a front-end surface of the normally-closed switch (4).

8. The inflation product of claim 1, wherein the front end of the air pump (1) is provided with a charge port (8) covered by a charge port sealing cover (10).

9. The inflation product of claim 8, wherein the air pump (1) comprises an outer cover (1.1) and an inner housing (1.2), which are fixedly connected, the outer cover (1.1) is disposed outside of the inflation product (15), the inner housing (1.2) protrudes into the inflation product (15), the air inlet (3) and the charge port (8) are both disposed on the outer cover (1.1), a circuit board (12), a battery (13), a fan (14) and a motor (16) are mounted inside the inner housing (1.2), and the normally-closed switch (4) is in electrical connection with the circuit board (12).

10. The inflation product of claim 8, wherein pull ropes (11) are fixed at a rear end of each of the air inlet sealing cover (5) and the charge port sealing cover (10), and rear ends of the pull ropes (11) are fixed inside the air inlet (3) and the charge port (8), respectively.

* * * * *